US008717252B2

(12) United States Patent
Liu et al.

(10) Patent No.: US 8,717,252 B2
(45) Date of Patent: May 6, 2014

(54) DUAL FREQUENCY ANTENNA

(75) Inventors: Peng Liu, Shenzhen (CN); Gee Siong Kok, Shenzhen (CN)

(73) Assignee: Hytera Communications Corp., Ltd., Shenzhen, Guangdong (KR)

( * ) Notice: Subject to any disclaimer, the term of this patent is extended or adjusted under 35 U.S.C. 154(b) by 177 days.

(21) Appl. No.: 13/375,885

(22) PCT Filed: Jul. 31, 2009

(86) PCT No.: PCT/CN2009/073025

§ 371 (c)(1),
(2), (4) Date: Dec. 2, 2011

(87) PCT Pub. No.: WO2011/011923

PCT Pub. Date: Feb. 3, 2011

(65) Prior Publication Data

US 2012/0119974 A1 May 17, 2012

(51) Int. Cl.
*H01Q 1/36* (2006.01)
*H01Q 1/24* (2006.01)

(52) U.S. Cl.
USPC ..... 343/895; 343/702

(58) Field of Classification Search
USPC ..... 343/895, 702
See application file for complete search history.

(56) References Cited

U.S. PATENT DOCUMENTS

| | | | | |
|---|---|---|---|---|
| 5,805,112 | A | 9/1998 | Cassel | |
| 6,140,973 | A * | 10/2000 | Annamaa et al. | 343/790 |
| 6,201,500 | B1 | 3/2001 | Fujikawa | |
| 6,340,954 | B1 * | 1/2002 | Annamaa et al. | 343/895 |
| 6,452,555 | B1 | 9/2002 | Chang et al. | |
| 6,473,056 | B2 * | 10/2002 | Annamaa | 343/895 |
| 6,525,692 | B2 * | 2/2003 | Kim et al. | 343/702 |
| 6,710,752 | B2 * | 3/2004 | Saito et al. | 343/895 |
| 7,202,836 | B2 * | 4/2007 | Ooi et al. | 343/895 |
| 2002/0097192 | A1 | 7/2002 | Chang et al. | |
| 2007/0241972 | A1 | 10/2007 | Grossman et al. | |

FOREIGN PATENT DOCUMENTS

| | | | |
|---|---|---|---|
| CN | 2523159 | | 11/2002 |
| CN | 2924817 | | 7/2007 |
| CN | 101421885 | A | 4/2009 |
| EP | 1 263 081 | A2 | 4/2002 |
| GB | 2 418 781 | A | 5/2006 |
| WO | WO 20070035064 | A1 | 3/2007 |

OTHER PUBLICATIONS

International Search Report dated May 6, 2010 from corresponding International Application No. PCT/CN2009/073025.
Extended European Search Report dated Feb. 20, 2013 from corresponding European Application No. EP 09847709.

* cited by examiner

*Primary Examiner* — Hoang V Nguyen
(74) *Attorney, Agent, or Firm* — Wolf, Greenfield & Sacks, P.C.

(57) ABSTRACT

A dual frequency antenna is provided, which includes a helical radiator electrically connected to a main body via a feed point of the main body, a first radiator for generating resonance is formed on the lower portion of said radiator, a second radiator for generating resonance is formed on the upper portion of said radiator, wherein the resonance frequency of the second radiator is higher than that of the first radiator, and the helical pitch of the second radiator is larger than that of the first radiator. The dual frequency antenna easily enables tuning in a whole UHF frequency band, and work performance of an upper semi-sphere of the dual frequency antenna is improved in a GPS frequency band.

11 Claims, 4 Drawing Sheets

DUAL FREQUENCY ANTENNA

FIELD OF THE INVENTION

The present invention relates to an antenna and in particular to a dual frequency antenna.

BACKGROUND OF THE INVENTION

At present, a handheld terminal device is typically provided with a plurality of frequency bands, for example, frequency bands required for the Global System for Mobile communications (GSM) and the Digital Cellular System (DCS) of a mobile phone (GSM+DCS) as well as an Ultra High Frequency (UHF) and a frequency of the Global Positioning System (GPS) of an interphone, etc., to enable a plurality of functions or auxiliary functions, wherein dual- or multi-frequencies antenna corresponding to the plurality of frequency bands is provided. In the prior art, it is common to adopt a dual frequency antenna in a structure of partial resonance in which a higher frequency band is designed with different structural parameters so that one frequency is generated throughout an antenna dipole while high frequency resonance arises from that a helix part with different parameters. In an early mobile phone antenna, for example, the DCS frequency band is typically placed at the bottom of a coil for handling.

Numerous dual frequency antennas operate in an operation mode of UHF+GPS frequency bands, which is typically implemented with partial resonance of a helical structure in a way that its part of high-frequency resonance is placed at the bottom of a coil and constitutes lower-frequency resonance together with the other part. Reference is made to FIG. 1 illustrating a schematic structural diagram of a dual frequency antenna with partial resonance in the prior art in which its part of GPS resonance is placed at the bottom of a helix to form resonance. For the GPS frequency band, good performance of the antenna is concentrated largely at the lower half of a spherical surface while poor performance is at the upper half of the spherical surface required for the GPS (its part pointing to the sky), which is not suitable for specialized GPS performance and functional positioning of specialized terminal devices.

The entire antenna can be tuned easily only if a frequency at which the antenna operating in the GPS frequency band is an odd multiple (e.g., one, three, five, seven, etc., times) of that in the UHF frequency band or otherwise might be difficult to tune in any other frequency band. For example, an external dual frequency antenna of an existing interphone operates in an operation mode of UHF+GPS frequency bands in which the entire Ultra High Frequency (UHF) band ranges from 300 to 870 MHz. When the frequency of GPS resonance is that of a three-order resonance relative to the UHF frequency band (five times of dominant frequency), easy tuning is possible only if the UHF frequency is approximately one fifth of 1575 MHz or otherwise might be difficult in any other frequency band and is almost impossible, let alone accurate tuning, especially at 3.5, 4.5, 5.5, etc., times of the frequency. Consequently, it may be inconvenient in the prior art to tune the GPS+UHF operating dual frequency antenna in some frequency bands, thus adverse to transmit and receive a signal in a plurality of frequency bands by the antenna.

SUMMARY OF THE INVENTION

The invention addresses a technical problem of providing a dual frequency antenna which can be tuned easily at more frequencies and performance of which can be concentrated better at the upper half of a spherical surface when the antenna operates in the GPS frequency band in order to overcome the drawbacks of the foregoing dual frequency antenna in the prior art which may be difficult to tune at a part of frequencies and performance of which can not be concentrated better at the upper half of a spherical surface when the antenna operates in the GPS frequency band.

The invention addresses the technical problem in such a technical solution that a dual frequency antenna is provided which includes a radiant body with a helical structure electrically connected to a host machine through feed point of the host machine, wherein the radiant body has a lower end arranged as a first radiator for generating resonance and an upper end arranged as a second radiator for generating resonance at a higher frequency than that of resonance of the first radiator, and the helical structure of the second radiator has a larger pitch than that of the helical structure of the first radiator.

The dual frequency antenna according to the invention further includes a linear third radiator connected with the top of the second radiator and provided with a free end extending inside the helical structures formed of the first and second radiators toward the feed point.

In the dual frequency antenna according to the invention, the length of the third radiator is equal or less than one fourth of the wavelength corresponding to the frequency at which the second radiator operates.

In the dual frequency antenna according to the invention, the helical structure of the second radiator has a pitch twice that of the helical structure of the first radiator.

In the dual frequency antenna according to the invention, the total length of the first and the second radiators is a length of resonance of the antenna in operation frequency bands.

In the dual frequency antenna according to the invention, the length of the second radiator is a length of resonance of the antenna in the GPS operation frequency band.

The dual frequency antenna according to the invention can be implemented with the following advantageous effects: both the first radiator and the second radiator with a pitch different from the first radiator and particularly larger than that of the first radiator are adopted so that resonance in the higher-frequency GPS frequency band occurs at the second radiator located at the top of the coil and UHF resonance occurs at the first radiator located at the bottom of the coil, thus the part of GPS resonance is located at the top of the helical structure to enable performance of the antenna to better concentrate at the upper half of a spherical surface when the antenna operates in the GPS frequency band.

Furthermore, the third radiator is added to form an adjusting element and cooperate with the second radiator for dual frequency tuning throughout the UHF frequency band.

BRIEF DESCRIPTION OF THE DRAWINGS

The invention will be further described hereinafter in connection with the embodiments and the drawings in which.

DETAILED DESCRIPTION OF THE INVENTION

According to the invention, a part of GPS resonance is arranged at the top of an antenna coil and a part of UHF resonance is arranged at the bottom of the antenna coil to achieve good directivity of an antenna at the upper half of a spherical surface, and also an adjusting element is added to an upper part of the antenna to interoperate with the rest of the antenna for dual frequency tuning throughout the UHF frequency band (300-800 MHz).

Figure 1:
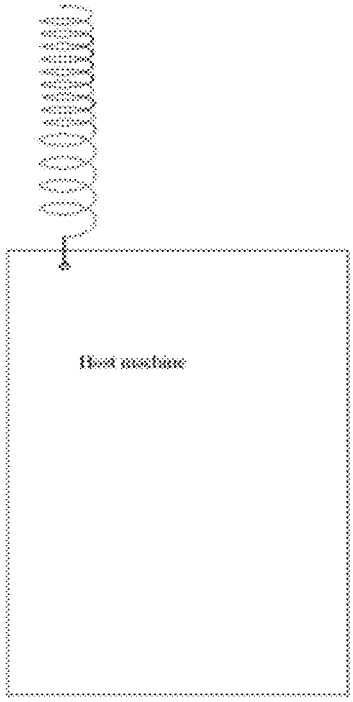
FIG. 1 is a schematic structural diagram of a dual frequency antenna with partial resonance in the prior art.
Figure 2:
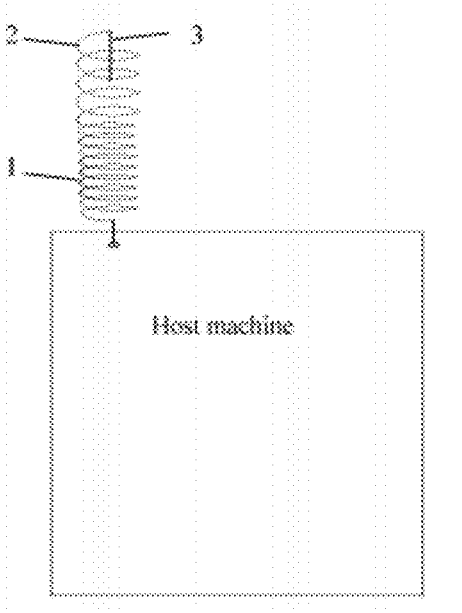
FIG. 2 is a schematic structural diagram of a first embodiment of a dual frequency antenna according to the invention.

Reference is made to FIG. 2 illustrating a schematic structural diagram of a preferred embodiment of a dual frequency antenna according to the invention, which includes a radiant body electrically connected with a feed point of a host machine. The radiant body includes three parts, i.e., a helical first radiator 1 for generating resonance, a helical second radiator 2 for generating resonance at a higher frequency than that of resonance at the first radiator 1 and a linear third radiator 3, which are connected sequentially from the bottom up. The third radiator 3 has one end connected with the top of the second radiator and the other free end located inside helical structures formed of the first radiator 1 and the second radiator 2 and extending toward the feed point. The length of the third radiator 3 is equal or less than one fourth of the wavelength corresponding to the frequency at which the second radiator 2 operates.

The helical structure of the second radiator 2 has a larger pitch than that of the first radiator 1 and the length of the second radiator is equal to a length of resonance of the antenna in the GPS operation frequency band, so that the upper part of the radiant body, i.e., the second radiator 2, generates resonance largely in the GPS frequency band, the lower part of the radiant body, i.e., the first radiator 1, generates resonance largely in the UHF frequency band, and the third radiator can perform tuning through coupling with the first and second radiators. Upon presence of only the helical radiators, an influencing factor of GPS resonance depends upon the structures of the first and second radiators, and with addition of the third radiator, the linear part and the helical parts cooperate so that the influencing factor of GPS resonance depends largely upon the third radiator. Therefore, GPS adjusting is possible with structural optimization of the third radiator so that the antenna can be GPS adjusted through the UHF frequency band. Preferably, the helical structure of the second radiator 2 has a pitch twice that of the helical structure of the first radiator 1, thus achieving better directivity of the antenna. The total length of the first radiator 1 and the second radiator 2 is a length of resonance of the antenna in the operation frequency bands, and when the third radiator 3 is fixed in length, dual frequency tuning can be achieved throughout the UHF frequency band (300-800 MHz) so long as the pitch of the second radiator 2 is larger than that of the first radiator 1, thus enabling the antenna to operate in more frequency bands.

Figure 3:
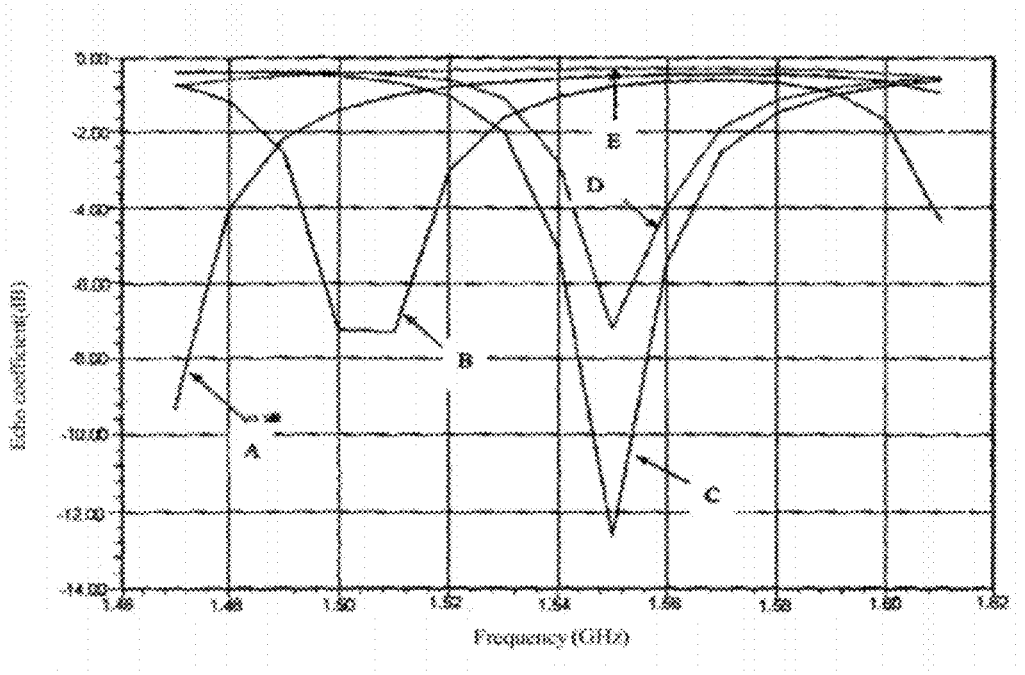
FIG. 3 is a schematic diagram of an echo loss in the GPS frequency band of an embodiment without a third radiator in FIG. 2.

Reference is made to FIG. 3 illustrating a schematic diagram of an echo loss in the GPS frequency band of an embodiment without the third radiator in FIG. 2, where graphs A, B, C, D and E represent schematic diagrams of an echo loss of the antenna in different structures respectively. Particularly, in the case of the graph A, the helical radiator has 13.5 circles and an operation frequency of the dual frequency antenna in the GPS frequency band is 400 MHz which is approximately 4.5 times of that in the UHF frequency band, and as can be apparent, the antenna suffers from a poor tuning effect; in the case of the graph B, the second radiator has 15 circles and an operation frequency of the dual frequency antenna in the GPS frequency band is 380 MHz which is approximately 4.75 times of that in the UHF frequency band; in the case of the graph C, the second radiator has 10.5 circles and an operation frequency of the dual frequency antenna in the GPS frequency band is 465 MHz which is approximately 3 times of that in the UHF frequency band; in the case of the graph D, the second radiator has 12 circles and an operation frequency of the dual frequency antenna in the GPS frequency band is 420 MHz which is approximately 4 times of that in the UHF frequency band; and in the case of the graph E, the second radiator has 15.5 circles and an operation frequency of the dual frequency antenna in the GPS frequency band is 388 MHz which is approximately 4.8 times of that in the UHF frequency band, and as can be apparent, the echo loss of the antenna in the graph E approximates 0 dBi, that is, the antenna receives an insignificant signal with a poor tuning effect, but in the graph C, the operation frequency of the antenna in the GPS frequency band approximates an odd multiple of that in the UHF frequency band, thus achieving a good tuning effect.

Figure 4:
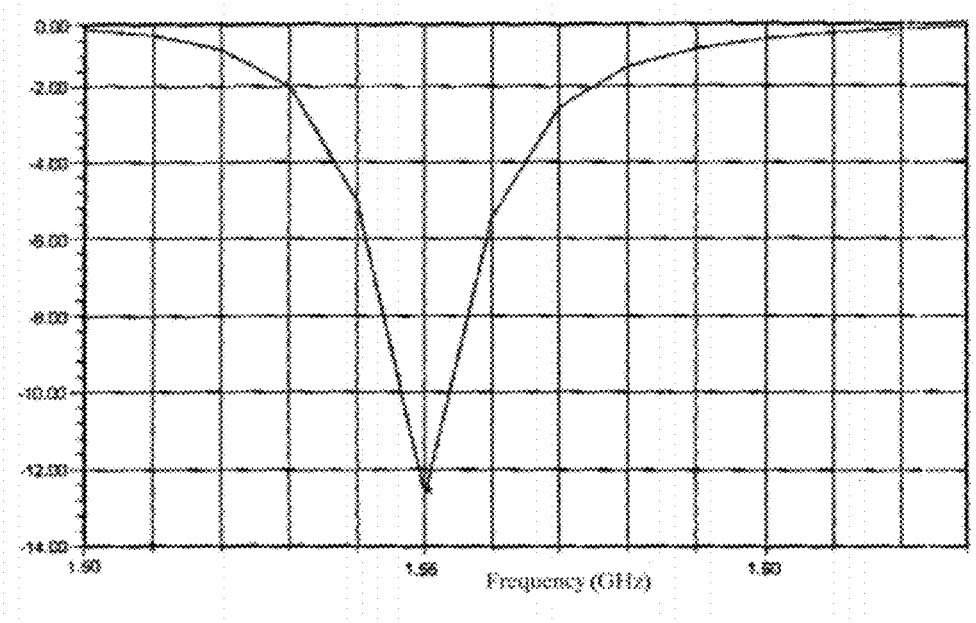
FIG. 4 is a schematic diagram of an echo loss in the GPS frequency band of an embodiment of a dual frequency antenna according to the invention.

Reference is made to FIG. 4 illustrating a schematic diagram of an echo loss in the GPS frequency band of an embodiment of a dual frequency antenna according to the invention, where UHF resonance occurs at approximately 400 MHz, and the operation frequency of the antenna in the GPS frequency band which has a good tuning effect is approximately 3.8 times of that in the UHF frequency band due to addition of the third radiator resulting in better tuning.

Figure 5:
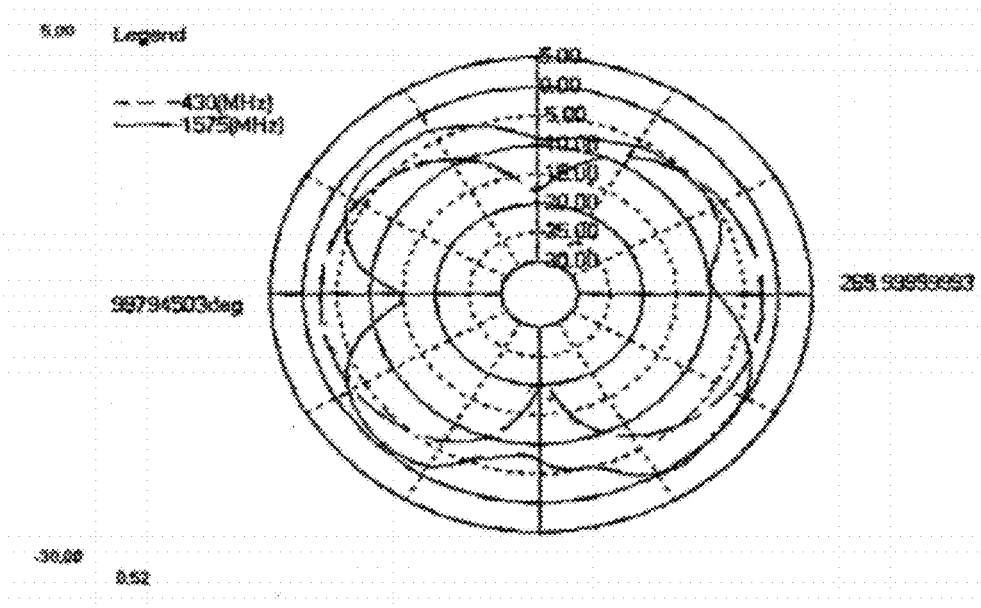
FIG. 5 is a 2D diagram of a darkroom test result of radiance performance in the UHF frequency band of a real model of an embodiment of a dual frequency antenna according to the invention.
Figure 6:
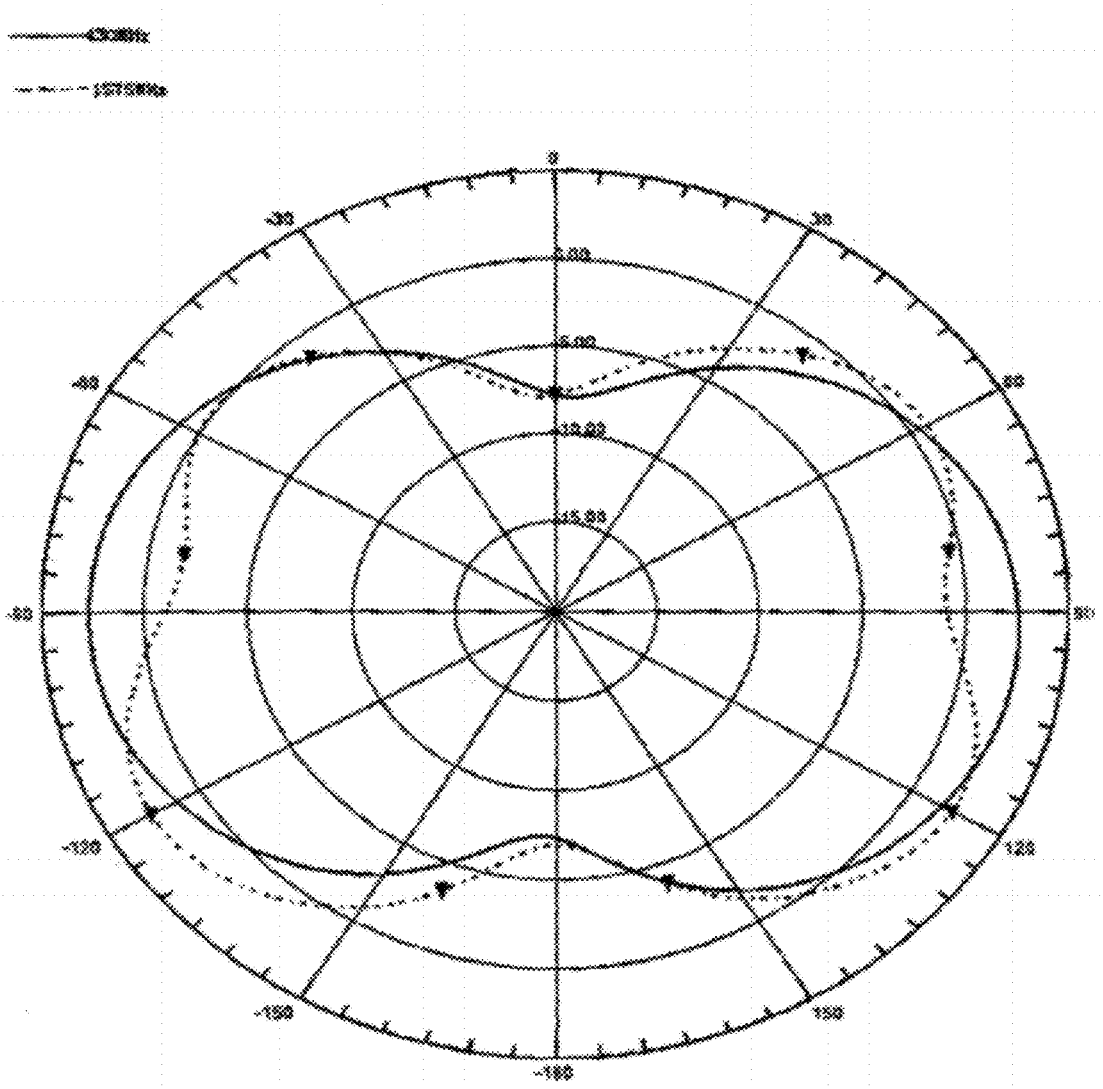
FIG. 6 is a 2D diagram of radiance performance in the UHF frequency band of a simulative test of an embodiment of a dual frequency antenna according to the invention.

Reference to FIGS. 5 and 6, FIG. 5 illustrates a 2D diagram of a darkroom test result of radiance performance in the UHF frequency band of a real model of an embodiment of a dual frequency antenna according to the invention; and FIG. 6 illustrates a 2D diagram of radiance performance in the UHF frequency band of a simulative test of an embodiment of a dual frequency antenna according to the invention. In FIG. 5, a solid line represents a radiation directivity diagram of the antenna operating at 1575 MHz and a dotted line represents a radiation directivity diagram of the antenna operating at 430 MHz; and in FIG. 6, a dotted line represents a radiation directivity diagram of the antenna operating at 1575 MHz and a solid line represents a radiation directivity diagram of the antenna operating at 430 MHz. As can be apparent, the darkroom test result demonstrates that efficiency of the antenna throughout the frequency band conforms to a customer's demand due to a gain of approximately 0dBi in both the UHF frequency band and the UHF frequency band. The antenna is free of an excessively deep recess at the upper half of a plane and thus provided with nearly symmetric parameters of the directivity diagram.

In general, the invention transfers an influencing factor of resonance in the GPS frequency band from the radiant body in a helical part to that in a linear part and performs GPS adjusting by the third part of the radiant body connected at the top of the antenna to achieve GPS adjusting throughout the UHF frequency band through structural optimization without influence on GPS performance. With the invention, it is possible to manufacture a product with good consistency and a low rejection rate. Such a dual frequency antenna can be applied widely to a variety of handheld terminal devices for reception of more signals at more angles of directivity.

The foregoing descriptions are merely illustrative of the preferred embodiments of the invention but not intended to limit the invention, and any modifications, substitutions or adaptations made without departing from the spirit and principal of the invention shall come into the claimed scope of the invention.

The invention claimed is:

1. A dual frequency antenna, comprising a radiant body with a helical structure electrically connected to a host machine through a feed point of the host machine, wherein the radiant body has a lower end arranged as a first radiator for generating resonance and an upper end arranged as a second radiator for generating resonance at a higher frequency than that of resonance of the first radiator, and the helical structure of the second radiator has a larger pitch than that of the helical structure of the first radiator, and wherein the radiant body further comprises a linear third radiator connected with the top of the second radiator and provided with a free end extending inside the helical structures formed of the first and second radiators toward the feed point, wherein the first radiator operates at UHF frequency band, the second radiator operates at GPS frequency band, and the linear third radiator performs tuning by coupling with the first radiator and the second radiator.

2. The dual frequency antenna according to claim 1, wherein the length of the third radiator is equal or less than one fourth of the wavelength corresponding to the frequency at which the second radiator operates.

3. The dual frequency antenna according to claim 2, wherein the helical structure of the second radiator has a pitch twice that of the helical structure of the first radiator.

4. The dual frequency antenna according to claim 2, wherein the total length of the first and the second radiators is a length of resonance of the antenna in operation frequency bands.

5. The dual frequency antenna according to claim 2, wherein the length of the second radiator is a length of resonance of the antenna in the GPS operation frequency band.

6. The dual frequency antenna according to claim 1, wherein the helical structure of the second radiator has a pitch twice that of the helical structure of the first radiator.

7. The dual frequency antenna according to claim 6, wherein the total length of the first and the second radiators is a length of resonance of the antenna in operation frequency bands.

8. The dual frequency antenna according to claim 6, wherein the length of the second radiator is a length of resonance of the antenna in the GPS operation frequency band.

9. The dual frequency antenna according to claim 1, wherein the total length of the first and the second radiators is a length of resonance of the antenna in operation frequency bands.

10. The dual frequency antenna according to claim 9, wherein the length of the second radiator is a length of resonance of the antenna in the GPS operation frequency band.

11. The dual frequency antenna according to claim 1, wherein the length of the second radiator is a length of resonance of the antenna in the GPS operation frequency band.

* * * * *

UNITED STATES PATENT AND TRADEMARK OFFICE

CERTIFICATE OF CORRECTION

PATENT NO. : 8,717,252 B2
APPLICATION NO. : 13/375885
DATED : May 6, 2014
INVENTOR(S) : Peng Liu et al.

It is certified that error appears in the above-identified patent and that said Letters Patent is hereby corrected as shown below:

On the title page, Item (73) should read:

(73) Assignee: Hytera Communications Corp., Ltd., Shenzhen, Guangdong (CN)

Signed and Sealed this
Eighth Day of July, 2014

Michelle K. Lee

Michelle K. Lee
*Deputy Director of the United States Patent and Trademark Office*